US005586809A

United States Patent [19]

Szmadzinski

[11] Patent Number: 5,586,809

[45] Date of Patent: Dec. 24, 1996

[54] HEIGHT ADJUSTMENT MECHANISM FOR A CHAIR BACKREST

[75] Inventor: John A. Szmadzinski, Muskegon, Mich.

[73] Assignee: Herman Miller, Inc., Zeeland, Mich.

[21] Appl. No.: 511,612

[22] Filed: Aug. 4, 1995

[51] Int. Cl.[6] ..... B60N 2/02

[52] U.S. Cl. ..... 297/353; 297/411.36

[58] Field of Search ..... 297/353, 411.36; 248/125.3

[56] References Cited

U.S. PATENT DOCUMENTS

| | | | |
|---|---|---|---|
| 979,149 | 12/1910 | Gay . | |
| 3,215,470 | 11/1965 | Swenson et al. . | |
| 4,043,592 | 8/1977 | Fries . | |
| 4,155,593 | 5/1979 | Swenson et al. . | |
| 4,156,544 | 5/1979 | Swenson et al. . | |
| 4,181,357 | 1/1980 | Swenson et al. . | |
| 4,451,084 | 5/1984 | Seeley . | |
| 4,621,864 | 11/1986 | Hill . | |
| 4,639,039 | 1/1987 | Donovan . | |
| 4,660,885 | 4/1987 | Suhr . | |
| 4,662,681 | 5/1987 | Favaretto | 297/353 X |
| 4,749,230 | 6/1988 | Tornero . | |
| 4,786,108 | 11/1988 | Dauphin . | |
| 5,007,678 | 4/1991 | DeKraker | 297/353 |
| 5,037,158 | 8/1991 | Crawford . | |
| 5,127,621 | 7/1992 | Uecker et al. . | |
| 5,176,356 | 1/1993 | Lorbiecki et al. . | |
| 5,468,051 | 11/1995 | Huang | 248/125.3 X |

FOREIGN PATENT DOCUMENTS

| | | | |
|---|---|---|---|
| 4029140 | 12/1994 | WIPO | 297/353 |

*Primary Examiner*—Jose V. Chen
*Assistant Examiner*—David E. Allred
*Attorney, Agent, or Firm*—Brinks Hofer Gilson & Lione

[57] ABSTRACT

A mechanism is provided for adjusting the height of the backrest relative to a chair seat. The adjustment mechanism for releasably retaining the backrest in a plurality of selected positions relative to a seat permits the chair to be shipped in a "knocked down" condition and easily assembled by the consumer. The adjustment mechanism includes a channel member that is secured to the backrest, and a support member carried by the chair that is slidably received in the channel member and rigidly locked in selected positions. The support member has vertically aligned rack teeth and the backrest has a movable catch having pawls that are adapted to engage the rack teeth. Movement of the catch places the pawls into engagement with the rack teeth to prevent the downward movement of the backrest from a selected vertical position.

25 Claims, 9 Drawing Sheets

HEIGHT ADJUSTMENT MECHANISM FOR A CHAIR BACKREST

BACKGROUND OF THE INVENTION

The present invention relates generally to a mechanism for adjusting the height of a backrest relative to the chair seat, and more particularly, to a rack and pawl mechanism that will facilitate the assembly of the chair at the user's cite after being shipped in a knock down condition.

An assembled chair requires a large shipping carton which augments the shipping cost. For this reason it is advantageous and economical to ship products such as chairs in a partially assembled or "knocked down" condition. Another advantage of shipping products such as chairs in the "knocked down" condition is that the individual components can be packaged such that the likelihood of damage during shipment is reduced as compared to shipping the fully assembled chair. However, when a product is shipped in the "knocked down" condition, the final assembly becomes the responsibility of the consumer. For this reason it becomes important that products that are to be shipped in the "knocked down" condition be designed and built for easy final assembly by the consumer.

The position of a chair's backrest relative to the chair seat is an important consideration in the comfort of the user. Thus, providing an adjusting mechanism that is easy and convenient for the user is important. An operator can locate the most appropriate location for the backrest if the adjustment is made while the user is seated in the chair. It is also important that the backrest can be adjusted in small increments in order to obtain the most suitable location. Since some users of chairs desire to adjust the backrest to accommodate the particular task that they are performing or to adjust to different locations to provide a variety of seating posture, it is important that the backrest can be easily and quickly adjusted.

For the foregoing reasons, there is a need for an adjustable backrest for a chair that can be inexpensively produced, conveniently and easily assembled after being shipped in the "knocked down" condition, and is simple and handy to readjust after final assembly.

SUMMARY OF THE INVENTION

The present invention is directed to an apparatus that can be easily assembled after being shipped in the "knocked down" condition, and can be adjusted in small increments by the operator while seated so that the person doing the adjusting can feel when the backrest is at its optimum location. In accordance with the invention, the portion of the adjusting mechanism carried by the backrest can be fully assembled before shipping and the backrest need only be slid over the seat support strap to complete the on site assembly.

The adjusting mechanism will permit the backrest to be adjusted upwardly by merely exerting an upward force on the backrest. This is particularly important when adjustments of small increments are desired. To accomplish such an upward adjustment, the person doing the adjustment can reach back with both hands and exert an upward pressure on both sides of the backrest. This adjustment could also be accomplished with a single hand.

The lever for releasing the catch mechanism is accessible from the front or back of the chair and by a person sitting in the chair. This lever must be depressed when it is desired to lower the location of the backrest.

This invention consists of a chair, including an adjustment mechanism for releasably retaining a backrest in a plurality of selected positions relative to a seat, that can be shipped in a "knocked down" condition and easily assembled by the consumer.

Further, this invention consists of an adjustment mechanism comprising a channel member that is adapted to be rigidly secured to one of said backrest and seat and a support member slidably received by the channel member and adapted to be rigidly secured to the other of said backrest and seat such that the backrest and seat can be assembled by a simple sliding operation.

The adjusting mechanism of this invention consists of vertically aligned rack teeth that extend from the support member and a movable catch having pawls that are adapted to engage the rack teeth, movement of the catch places the pawls into engagement with the rack teeth to prevent the downward movement of the backrest from a selected vertical position.

The present invention, together with further objects and advantages, will be best understood by reference to the following detailed description taken in conjunction with the accompanying drawings.

DETAILED DESCRIPTION OF THE PREFERRED EMBODIMENT

Figure 1:
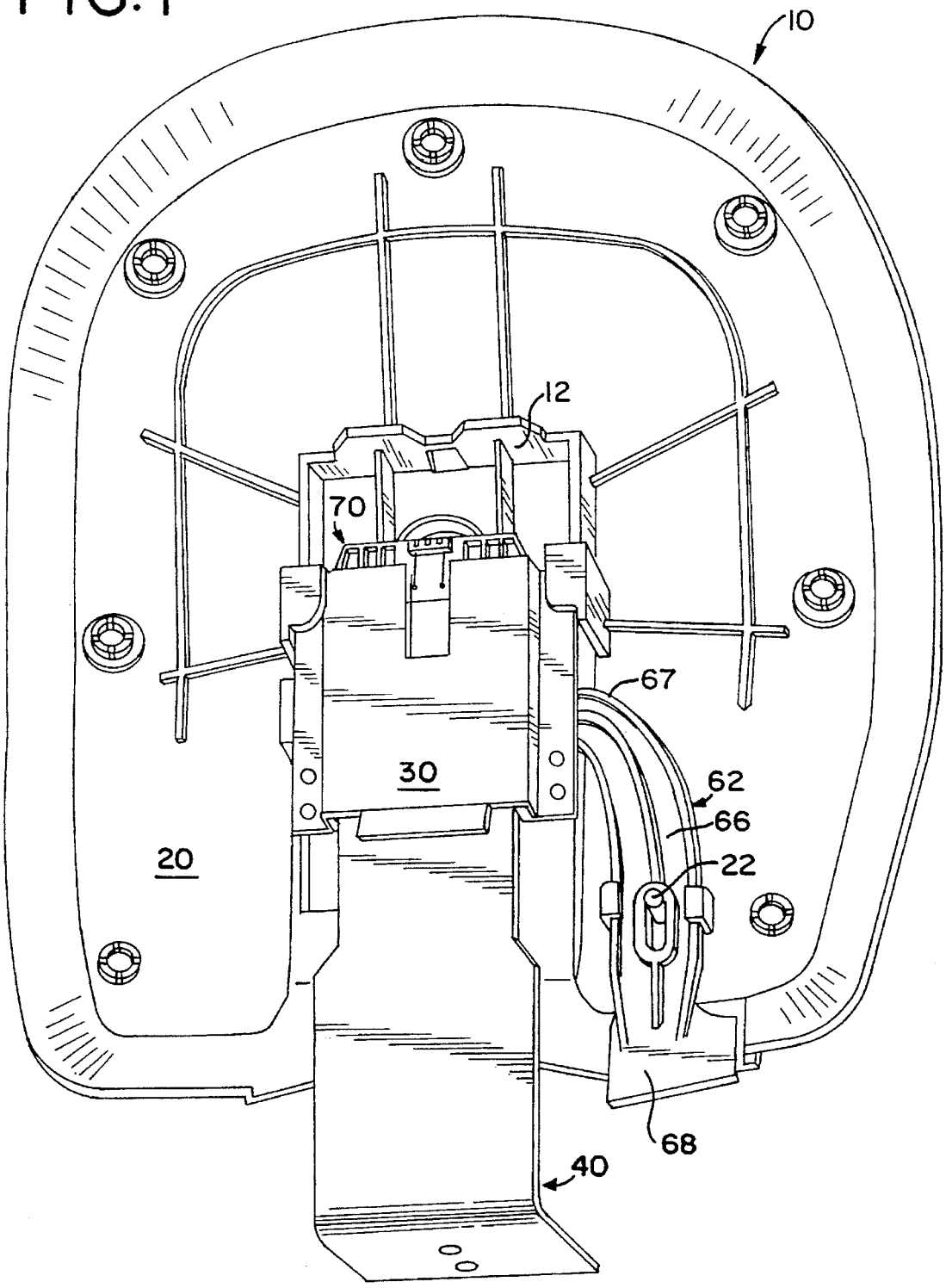
FIG. 1 is a perspective view of a seat backrest locked in a selected position relative to a chair support member.

Referring to the drawings, FIG. 1 shows the back of a chair backrest 10 adjustably connected to a chair support member or strap 40. As is well known in the art, the support member is rigidly secured to the seat of a chair. The back of the backrest 10 is formed by a hard cast plastic shell 20 that has formed integrally therewith a portion of a socket 11 for receiving the strap or support member 40. The socket 11, (see FIG. 2) includes a horizontally extending rib 12 that extends outwardly from the shell. As shall be described in more detail, the rib 12 acts as a stop that contacts the upper edge of the stop pad or support member 70 when the backrest 10 is lowered to its lowermost position. The socket 11 also includes vertically extending walls 13 and 14 that join with the rib 12 at their upper ends. Tabs 15 and 16 extend toward each other from the vertically extending walls 13 and 14. The socket 11 is reinforced by a plurality of radially extending ribs 17 and internal ribs 18 all of which are cast integrally with the hard cast plastic shell 20. Other ribs define a horizontally extending channel 19 that is open at the right side for a purpose to be described.

The socket 11 is completed by a U-shaped channel member 30 that includes outwardly extending mounting flanges 32 that are connected to the vertically extending walls 13 and 14 by fastener devices 34. The mounting flanges 32 extend under the tabs 15 and 16. With the channel member 30 secured to the vertically extending walls 13 and 14 a vertically extending socket having a rectangular shaped cross section has been provided that is adapted to receive the upper end of the strap or support member 40.

Figure 2:
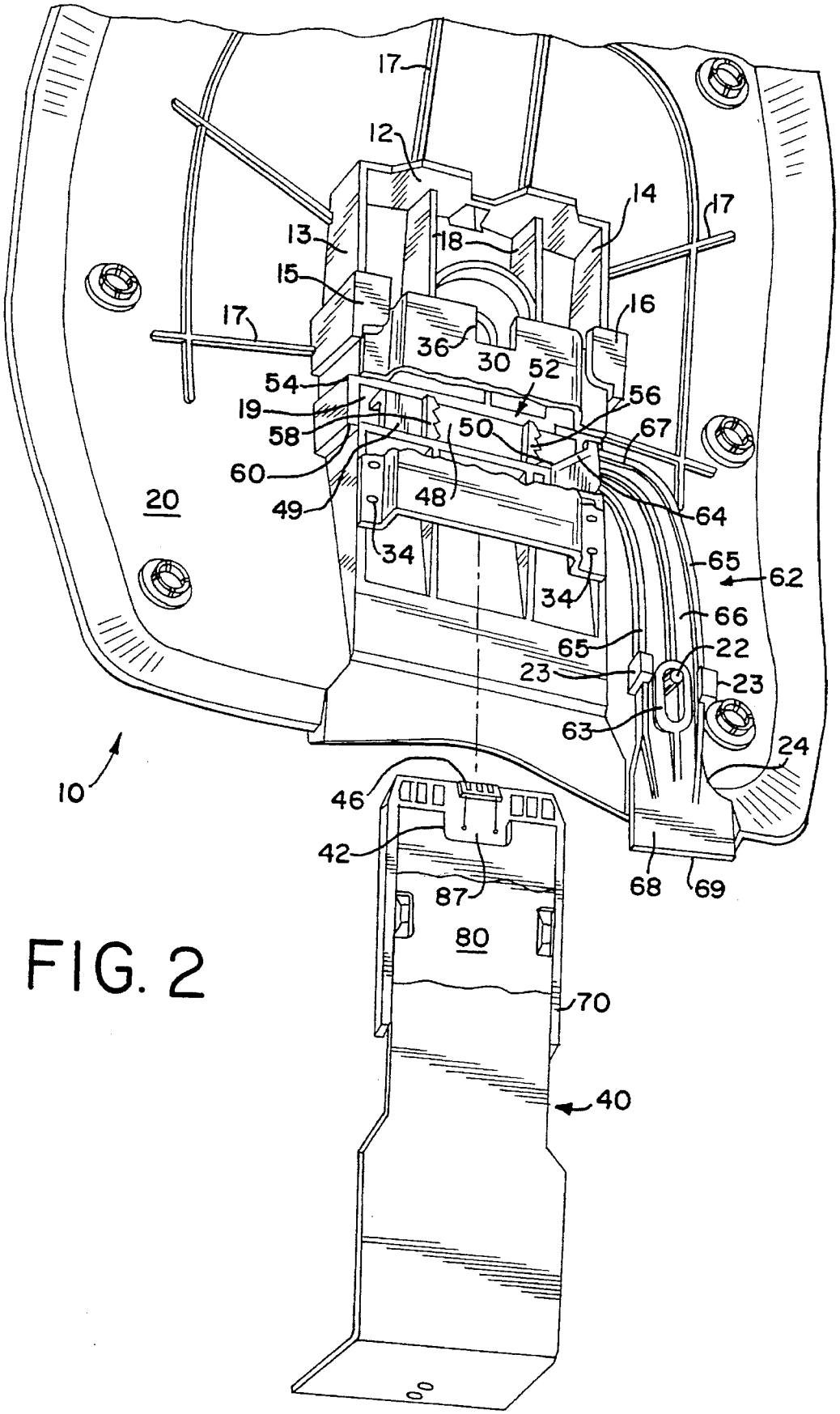
FIG. 2 is an exploded perspective view of a seat backrest and a chair support member.

Referring now to FIGS. 2, 7, 8, 9 and 10, the catch 48 will be discussed. FIG. 2 is similar to FIG. 1, however, the strap or support member 40 has been withdrawn from the socket and a section of the channel member 30 has been cut away to expose the catch 48. The catch 48, as best seen in FIGS. 7–10, has a generally rectangular shape and includes an angled end surface 50. The catch 48 is slidably received in horizontally extending channel 19 that is formed integrally with the hard plastic cast shell. The catch 48 and the channel 19 are sized such that although the catch can move horizontally in the groove, it is confined to sliding straight line movement as a result of the sliding engagement of the catch 48 with the walls of the channel 19. The catch 48 has an outer surface 49, that lies in a vertical plane when the catch is installed as seen in FIG. 2. First pawl 52 and second pawl 54 protrude outwardly from the surface 49 of the catch 48. The first pawl 52 includes a plurality of vertically aligned catch teeth 56, the upper edges of which are inclined and the lower edges of which are horizontal. The second pawl 54 includes a plurality of vertically aligned catch teeth 58, the upper edges of which are inclined and the lower edges of which are horizontal. The first pawl 52 and second pawl 54 are spaced apart in the horizontal direction and the teeth 56 and 58 extend in the same direction.

Figure 10:
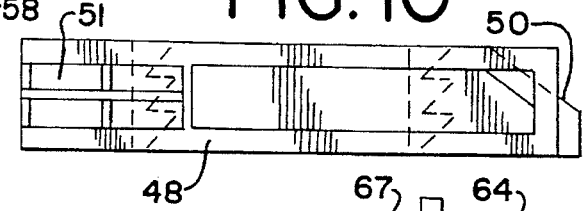
FIG. 10 is a bottom view of the catch.
Figure 18:
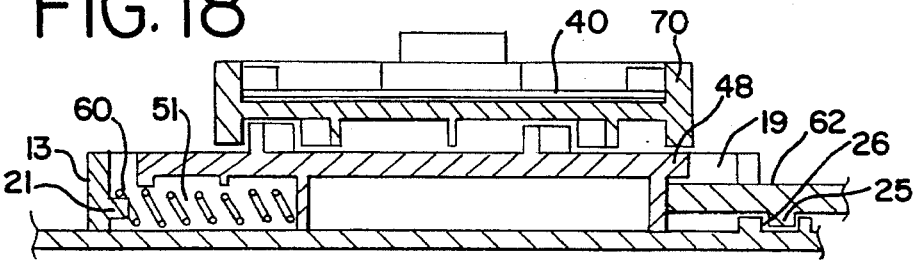
FIG. 18 is a partial cross-sectional view of the rack, pawl and lever taken along lines 18—18 of FIG. 15.
Figure 16:
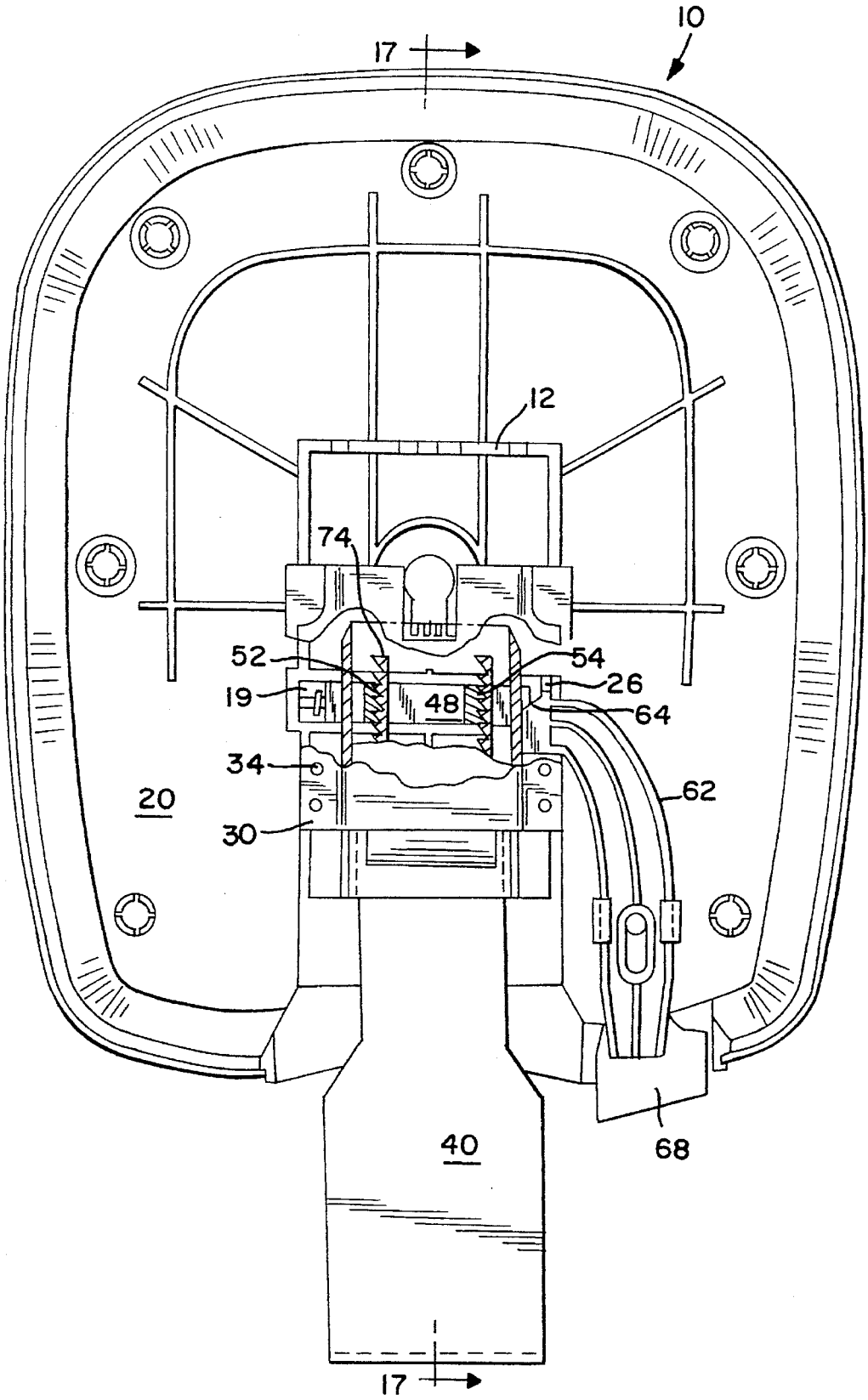
FIG. 16 is a back view of the backrest and seat support member, with the backrest in its highest adjusted position, and with a portion of the channel broken away-If expose the engaged teeth of the rack and pawl.
Figure 17:
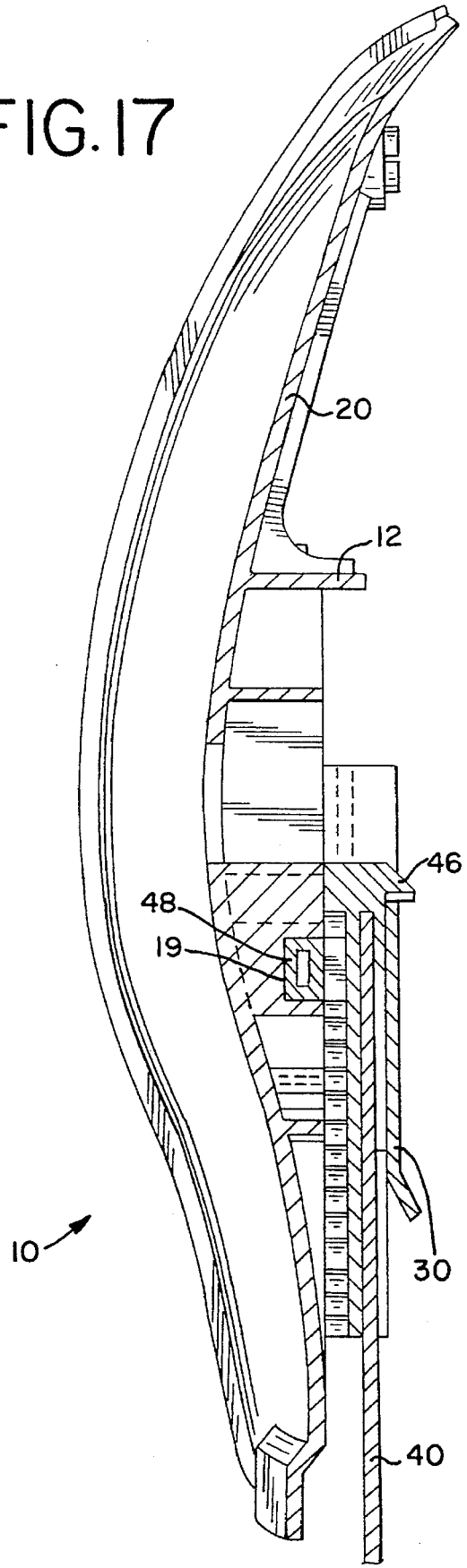
FIG. 17 is a cross-section view of the backrest and seat support member taken along lines 17—17 of FIG. 16.

The channel 19 is open on the right side as seen in FIG. 2 and the angled end surface 50 of the catch 48 is located at the open end of the groove. The angled end surface 50 is in sliding engagement with a complimentary angled end surface 64 of a lever 62. As best seen in FIG. 10, the catch 48 has a spring receiving notch 51 at its end opposite to the angled end surface 50. A coil spring 60 is seated against vertically extending wall 13 over a guide pin 21, and extends into notch 51. Coil spring 60 functions to bias the catch 48 to the right as seen in FIGS. 2, 13 and 18.

Figure 11:
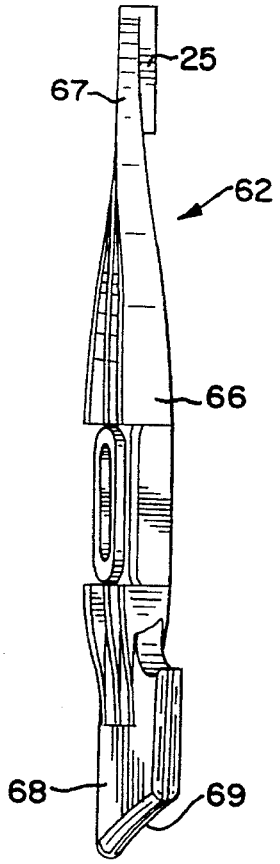
FIG. 11 is a side view of the lever.
Figure 12:
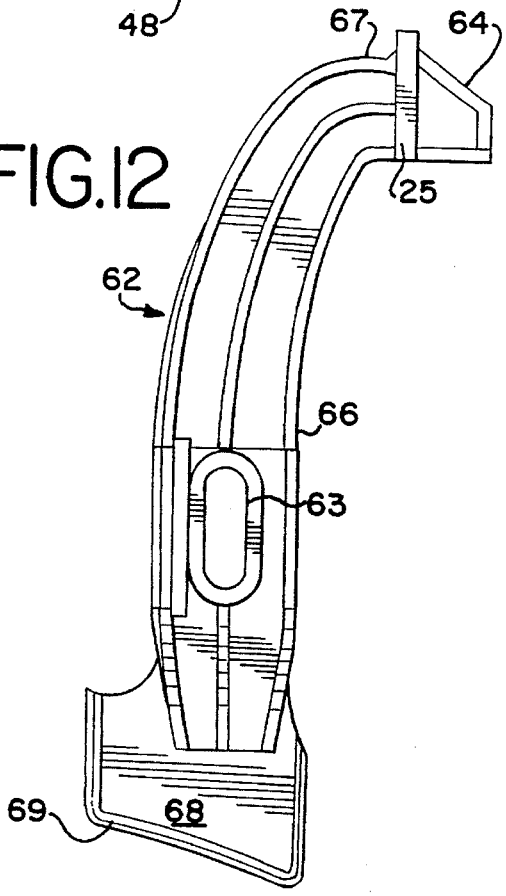
FIG. 12 is a bottom view of the lever.

The lever 62, shown isolated in FIGS. 11 and 12, has an upper generally horizontally extending portion 67 and a lower generally vertically extending portion 66. It should be noted that FIG. 12 is a bottom view of the lever 62, and thus, appears reversed from its appearance in the other Figures. The generally horizontally extending portion 67 terminates in a complimentary angle end surface 64 that is in sliding engagement with angled end surface 50 of catch 48. The lever 62 is confined to vertically sliding movement on the surface of the hard cast plastic shell 20 by a guide pin 22 and a groove 26 that are, in the preferred embodiment, cast integrally with the hard east plastic shell 20. The lever 62 has a reinforced groove 63, dimensions to slidably receive pin 22, formed in its generally vertically extending portion 66. The lever 62 has a downwardly protruding vertically extending shoulder 25, (see FIG. 12) that slides in the groove 26 formed in the hard shell. Edge guides 23, that are cast integrally with the hard cast plastic shell 20, are located on either side of the reinforced groove 63. The edge guides 23 engage flat surfaces on the upper surface of lever 62 and function to retain the lever 62 against the surface of the hard cast plastic shell 20. The lever 62 is provided with a rim 65 around its edge that function to strengthen and reinforce it. The rim 65 is removed (see FIG. 11) from the upper surface of the lever 62 in the area where the edge guides 23 are located. The lowermost edge of the generally vertically extending portion 66 is a handle 68. It should be noted that a fiat surface of the handle 68 slides against a complementary fiat surface 24 of the hard cast plastic shell 20. The bottom edge 69 of the handle 68 extends below the bottom edge of the backrest 10 and thus, can be seen and manipulated from the front as well as the back of the chair.

Figure 13:
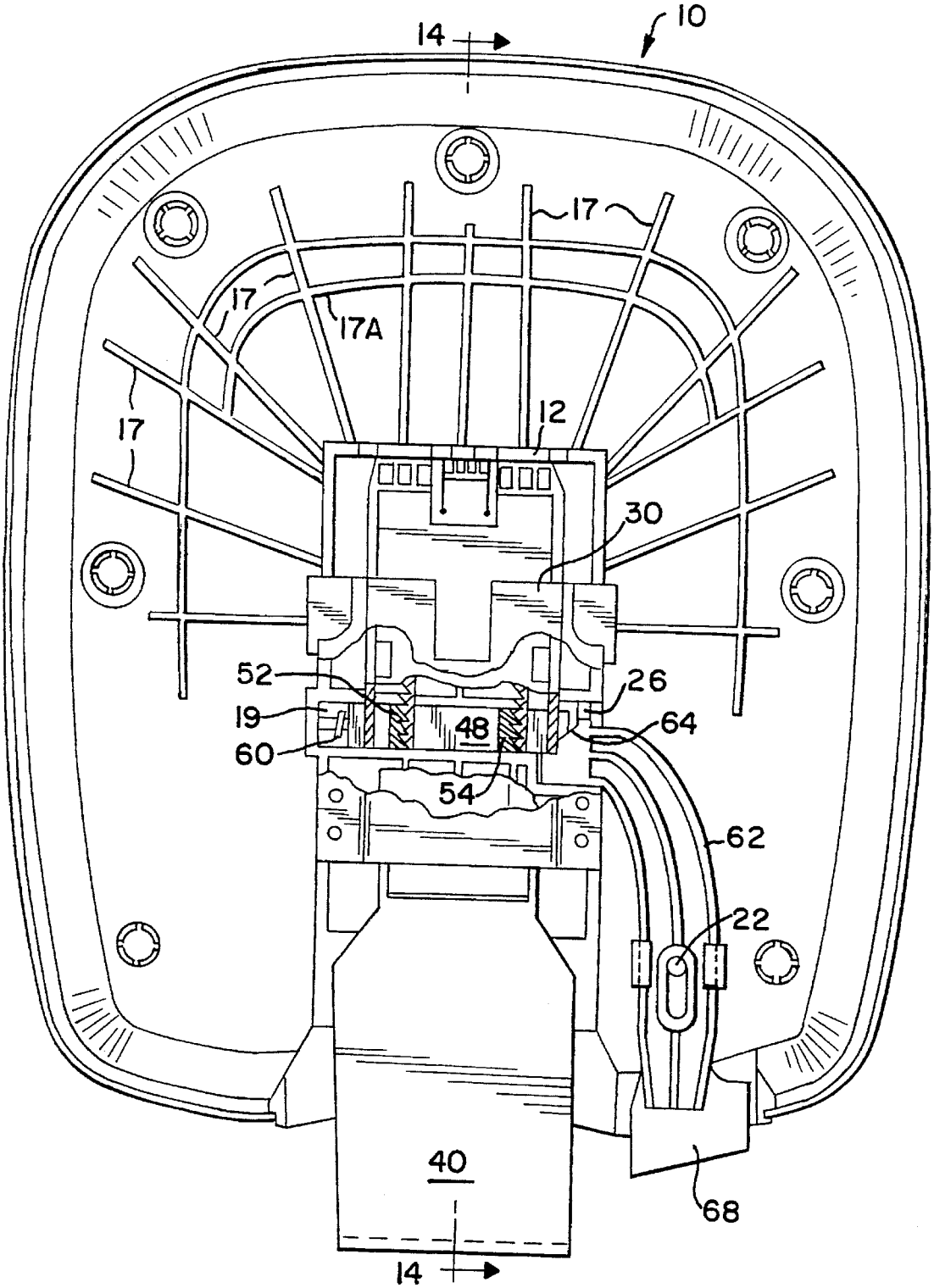
FIG. 13 is a back view of the backrest and seat support member, with the backrest in its lowest adjusted position, and with a portion of the channel broken away to expose the engaged teeth of the rack and pawl.
Figure 14:
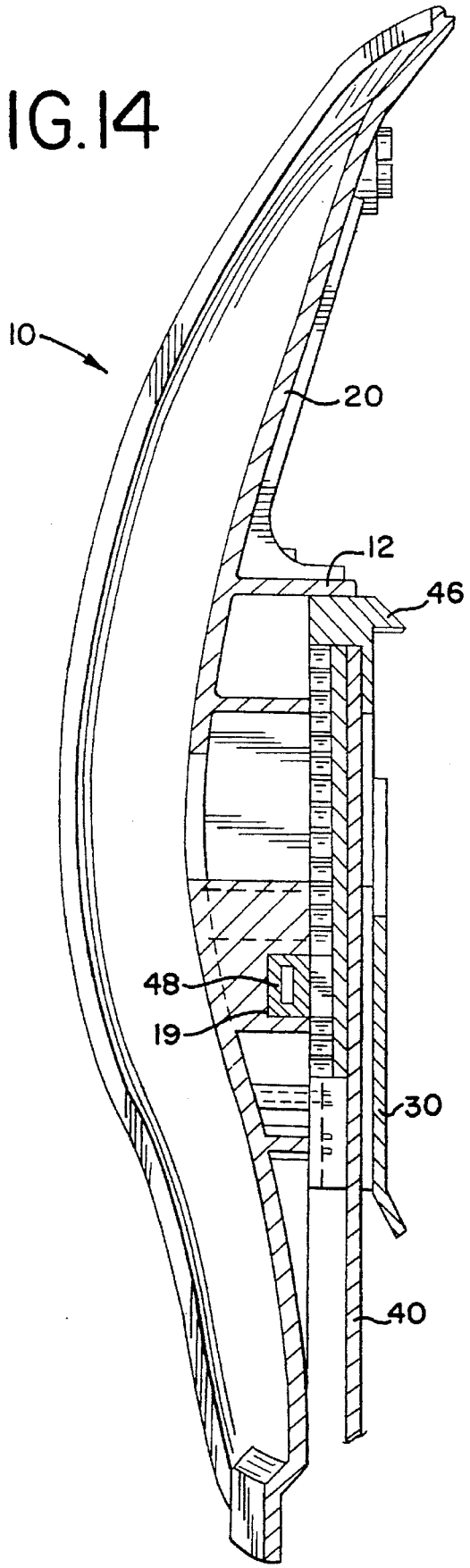
FIG. 14 is a cross-section view of the backrest and seat support member taken along lines 14—14 of FIG. 13.
Figure 15:
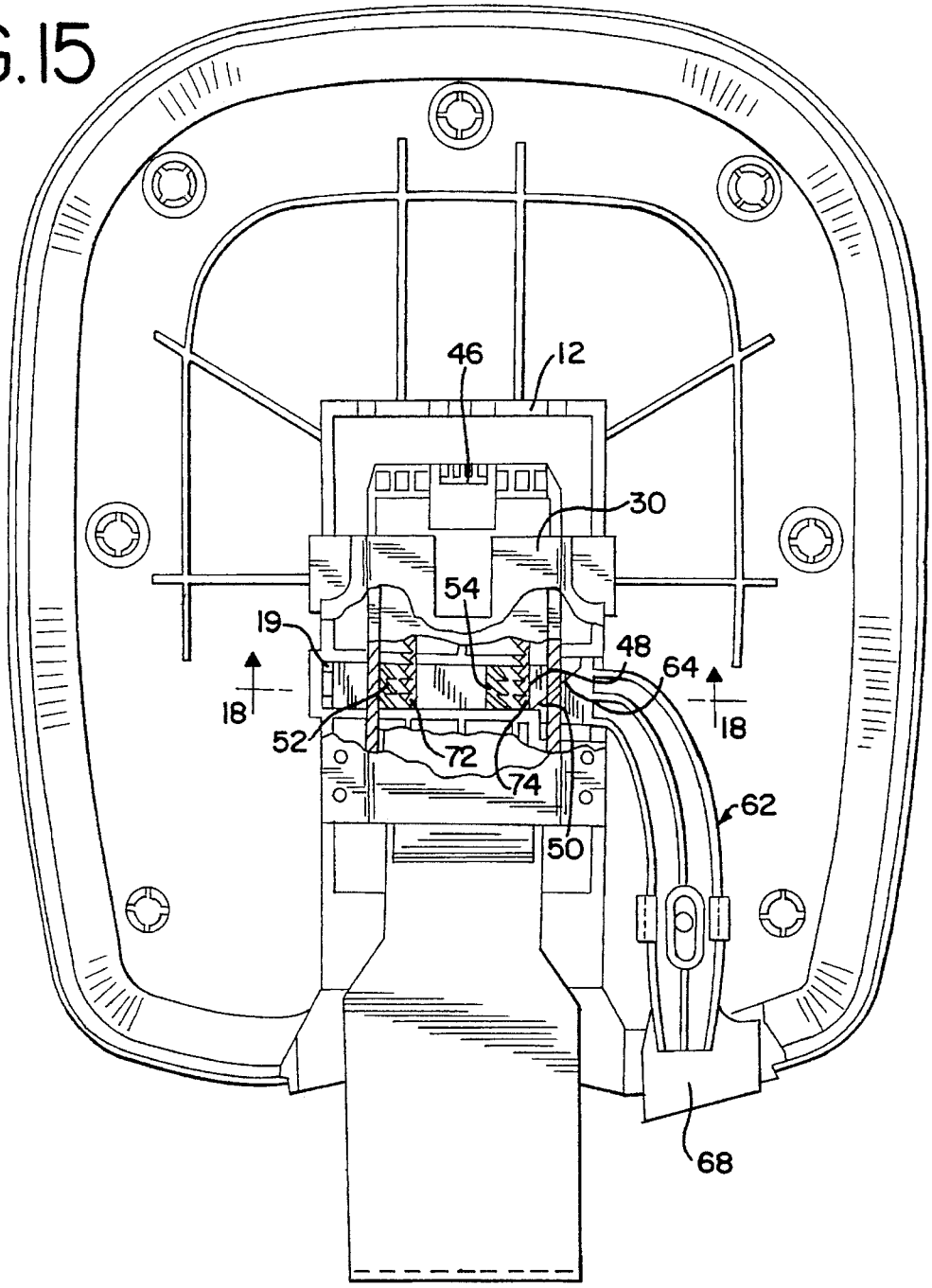
FIG. 15 is a back view of the backrest and seat support member with a portion of the channel broken away to expose the disengaged teeth of the rack and pawl.

FIG. 13 discloses the preferred embodiment of the radially extending reinforcing ribs 17. In FIG. 13 an additional C-shaped rib 17A and several additional radially extending ribs 17 have been added that are not disclosed in the embodiment disclosed in the other Figures.

Figure 3:
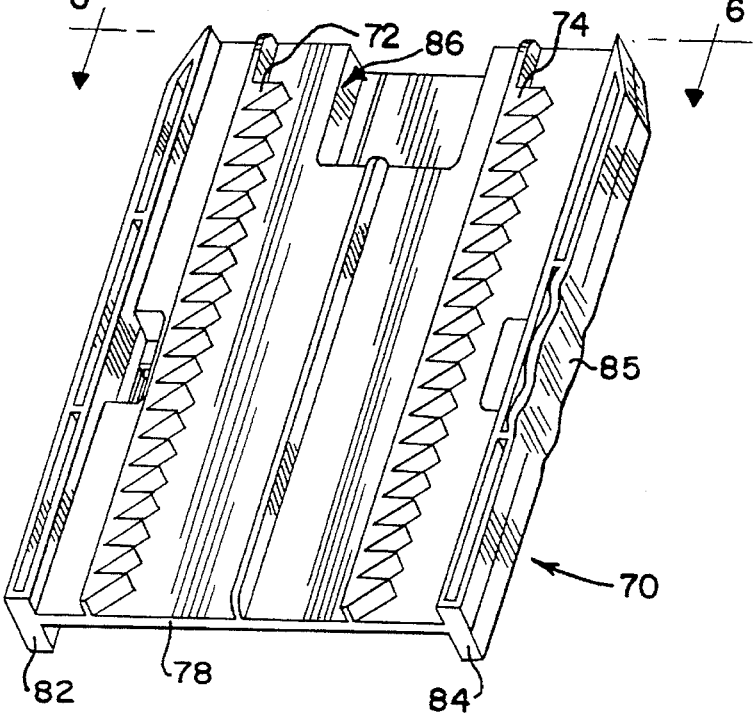
FIG. 3 is a perspective view of the bottom surface of the stop pad or support member.
Figure 5:
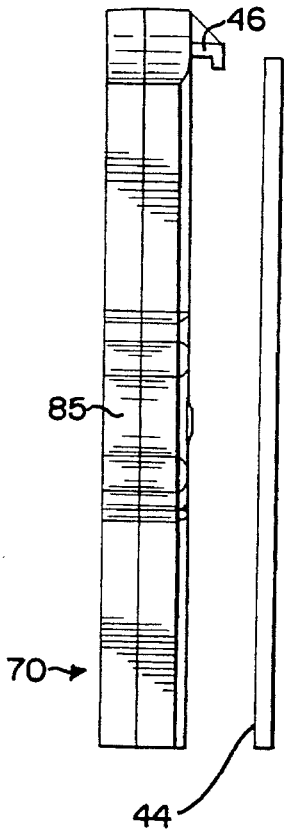
FIG. 5 is a side view of the stop pad or support member.
Figure 4:
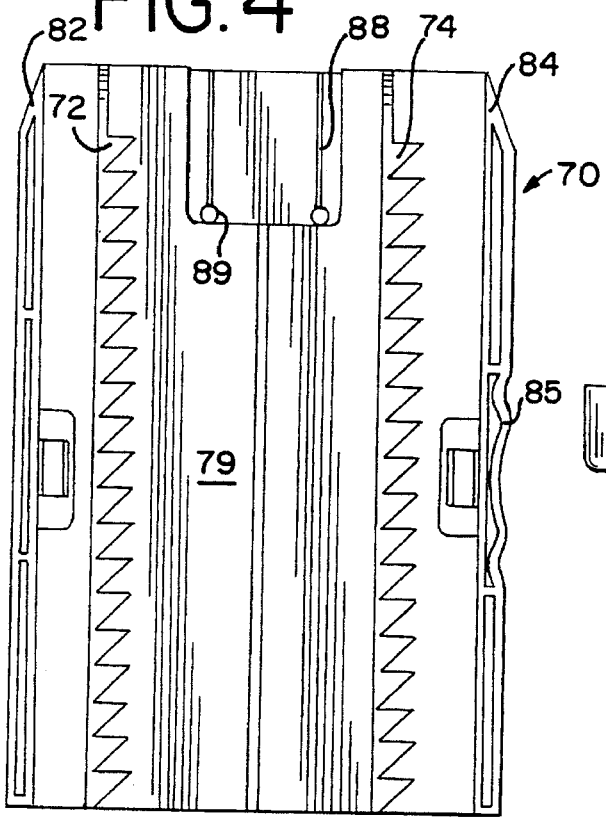
FIG. 4 is a plan view of the bottom surface of the stop pad or support member
Figure 6:
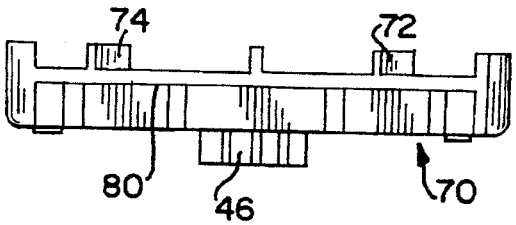
FIG. 6 is an end view of the stop pad or support member.
Figure 7:
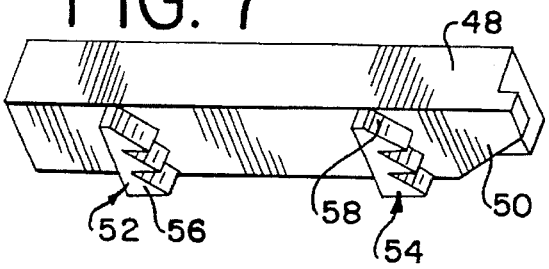
FIG. 7 is a perspective view of the catch.
Figure 8:
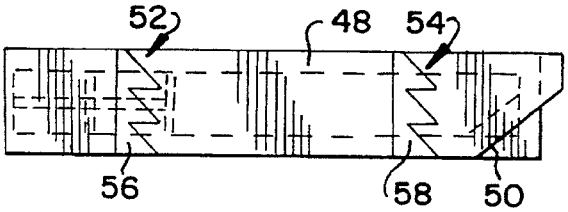
FIG. 8 is a plan view of the catch.
Figure 9:
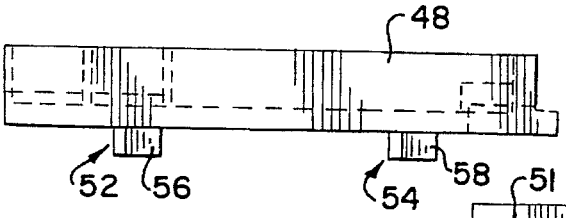
FIG. 9 is a side view of the catch.

Isolated illustrations of the stop pad or support member 70 are shown in FIGS. 3 through 6. The stop pad or support member 70 has a cross section similar to that of an I-beam. The web plate 78 has flanges 82 and 84 along its longitudinal edges. The surface 79 of web plate 78 seen in FIGS. 3 and 4 is the surface that faces the backrest 10. A portion of the opposite surface 80 of the web plate 78 can be seen in FIG. 2 below the broken away portion of the strap or support member 40. The strap 40 is secured to the surface 80 of the stop pad or support member 70. The upper edge of strap 40 has a notch 42 formed therein that receives a box segment 86, which will be further discussed, when the strap 40 is secured to the surface 80 of the stop pad or support member 70. In the preferred embodiment, a foam pad 44 (see FIGS. 5 and 18) having adhesive on both surfaces is used to secure strap 40 to surface 80; however, other adhesive means or fastening devices could be used. It should be noted that the foam pad 44 seen in FIGS. 5 and 18 is not included in the other Figures in an effort to simplify and clarify the drawings.

A first set or plurality of rack teeth 72 protrude upwardly from the surface 79 of web plate 78 and extend parallel to flange 82. A second set or plurality of rack teeth 74 protrude upwardly from the surface 79 of web plate 78 and extend parallel to flange 84. The rack teeth 72 and 74, as seen in FIGS. 3 and 4 have flat horizontal upper surfaces and flat inclined lower surfaces. A box segment 86 protrudes from the upper central portion of surface 80. The top surface 87 (see FIG. 2) of the box segment 86 lies in the plane of the edges of flanges 82 and 84. A hook tab 46 extends upward and then downward from the top surface 87. As best seen in FIG. 4, slots 88 that terminate in stress relieving holes 89, are cut into the top surface 87 to thus provide a cantilever spring mount for the hooked shaped tab 46. The cantilever spring mount for the hooked shaped tab 46 allows it to be depressed when the strap 40 with the stop pad or support member 70 secured thereto is inserted through the channel formed on the backrest 10 and to then spring back out when the top edge of the stop pad or support member has emerged from the channel. After the backrest 10 has been assembled on the strap 40, the hooked shaped tab 46 is free to engages a notch 36, as seen in FIG. 2, formed in the upper edge of the U-shaped channel member 30 and in so doing functions as a limit stop when the backrest is at its highest position. A spring member 85 is provided in the outer surface of flange 84 that engages the inner surface of the U-shaped channel member 30 to insure a snug sliding action there between.

The backrest 10 is assembled by the manufacturer with the components positioned as shown in FIG. 2. With the components so positioned, the spring 60 urges the catch 48 to the right, causing its angled end surface 50 to exert pressure against complimentary angled end surface 64 of the lever 62 which causes the lever 62 to shift downward to the location where pin 22 engages the upper end of slot 63. The catch 48 could raise up from its position in the horizontally extending channel 19 but is prevented from leaving the channel 19, by the U-shaped channel member 30.

The backrest 10 can be lowered over the strap or chair support member 40 such that the top edge of the stop pad or support member 70 is inserted into the socket 11. As the top edge of the stop pad or support member 70 enters the socket 11, the inclined edge of the hook 46 encounters the edge of the U-shaped channel member 30. The hook 46, as a result of its cantilever spring mounting, is depressed and slides along the inner surface of the U-shaped channel member as the backrest is lowered on the strap 40 and stop pad or support member 70. When the hook 46 reaches the notch 36, formed in the U-shaped channel member 30, it springs out. If the backrest 10 is thereafter moved upwardly, the hook 46 catches on the horizontal edge of notch 36 and prevents further upward movement of the backrest 10. If it is desired to remove the backrest 10 from the strap 40, the hook 46 is manually depressed as the backrest 10 is raised.

When installing the backrest 10 on the strap 40, the lever 62 must be engaged to shift the catch 48 from the right to the left as seen in FIG. 2. The lever 62 is engaged by applying an upward pressure on the handle 68 which causes the angled end surface 64 to move upwardly. The end surface 64 is in engagement with the angled end surface 50 which is caused to shift to the left in response to the upward movement of the angled end surface 64. If the lever 62 was not depressed when installing the backrest 10 on the strap 40, the flat upper surfaces of the rack teeth 72 and 74 would encounter the flat bottom surfaces of the catch teeth 56 and 58, which would prevent further downward movement of the backrest 10. Shifting the catch 48 to the left carries the catch teeth 56 and 58 with it and, as seen in FIG. 2, permits the rack teeth 72 and 74 to pass to the right of the catch teeth 56 and 58. After the backrest 10 has been installed, the lever 62 is released, and the catch teeth 56 and 58 move to the right into engagement with the rack teeth 72 and 74. It should be noted that the inclined surfaces of the catch teeth 56 and 58 move into surface to surface engagement with the inclined surfaces of rack teeth 72 and 74 when the lever 62 is released. With these surfaces in engagement if the backrest is moved upwardly the catch teeth 56 and 58 will be cammed to the left by the inclined surfaces of the rack teeth 72 and 74. When the catch teeth 56 and 58 reach the peak of rack teeth 72 and 74, coil spring 60 will cause them to snap into surface to surface contact with the next set of rack teeth 72 and 74. Thus, step by step ratcheting of the backrest 10 up the strap 40 is provided. The teeth 56, 58, 72 and 74 have a vertical dimension of about one quarter of an inch and thus, the height of the backrest can be raised in increments of one quarter of an inch. As previously stated, if it is desired to lower the backrest 10 relative to the strap 40, the lever 62 must be depressed and the backrest lowered while it is depressed. The backrest 10 will lock at the location where it is when the lever 62 is released.

It is intended that the accompanying drawings and foregoing detailed description are to be considered in all respects as illustrative and not restrictive; the scope of the invention is intended to embrace any equivalents, alternatives, and/or modifications of elements that fall within the spirit and scope of the invention, and all changes which come within the meaning and range of equivalency of the claims are therefore intended to be embraced therein.

We claim:

1. An adjustment mechanism for releasably retaining a backrest in a plurality of selected positions relative to a seat, the adjustment mechanism comprising:

a channel member adapted to be rigidly secured to one of said backrest and seat;

a support member slidably received by said channel member and adapted to be rigidly secured to the other of said backrest and seat;

a first plurality of vertically aligned rack teeth extending in a generally lateral direction from one of the channel member and support member;

a second plurality of vertically aligned rack teeth extending from said one of the channel member and support member in the same direction as the first plurality of rack teeth, said second plurality of rack teeth being spaced apart from and generally parallel to said first plurality of rack teeth; and a catch having a first pawl and a second pawl adapted to simultaneously selectively engage the respective first and second plurality of rack teeth, wherein said catch slides in a plane defined by the first and second plurality of rack teeth and places the first and second pawls into engagement with the first and second plurality of rack teeth;

whereby the backrest is retained from falling downwardly from a desired vertical position by the engagement of the first and second pawls with the first and second plurality of rack teeth.

2. The adjustment mechanism of claim 1 wherein the first and second pawls are horizontally aligned and extend in the opposite direction as the first and second plurality of rack teeth, and wherein said catch is adapted to move in a linear, horizontal direction to releasably engage said first pawl with selected ones of said first plurality of rack teeth and said second pawl with selected ones of said second plurality of rack teeth.

3. The adjustment mechanism of claim 2 further comprising a spring for biasing the first and second pawls into engagement with said first and second plurality of rack teeth, and a lever in operable engagement with the catch, said catch having an angled end portion in slidable engagement with a complementary angled end portion of the lever such that movement of the lever creates a camming action which moves the catch in said linear, horizontal, lateral direction.

4. The adjustment mechanism of claim 3 wherein the lever has a lower vertical portion which is slidably mounted to the backrest, whereby vertical actuation of the lever is translated into horizontal actuation of the catch.

5. The adjustment mechanism of claim 1 wherein the first pawl comprises a first plurality of vertically aligned catch teeth which mate with selected ones of said first plurality of rack teeth, and the second pawl comprises a second plurality of vertically aligned catch teeth which mate with selected ones of said second plurality of rack teeth.

6. The adjustment mechanism of claim 1 wherein the first and second plurality of rack teeth and the first and second pawls are configured so that the backrest is movable upwardly as the first and second pawls engage the first and second plurality of rack teeth in ratchet-like fashion.

7. The adjustment mechanism of claim 6 wherein the first and second plurality of rack teeth extend from the support member which is rigidly secured to the seat, and each of the first and second plurality of rack teeth is defined by a substantially horizontal upper edge and an upwardly inclined lower edge, and each of the first and second pawls is defined by an upwardly inclined upper edge and a substantially horizontal lower edge.

8. An adjustment mechanism for releasably retaining a backrest in a plurality of selected positions relative to a seat, the adjustment mechanism comprising:

a channel member adapted to be rigidly secured to the backrest;

a support member slidably received by said channel member and adapted to be rigidly secured to the seat;

a first plurality of vertically aligned rack teeth extending in a generally lateral direction from the support member;

a second plurality of vertically aligned rack teeth extending from the support member in the same direction as the first plurality of rack teeth, said second plurality of rack teeth being spaced apart from and generally parallel to said first plurality of rack teeth;

a catch having spaced apart, horizontally aligned, first and second pawls extending in the opposite direction as the first and second plurality of rack teeth, said catch being slidably mounted to one of the channel member and the support member, wherein actuation of the catch causes movement thereof in a linear, horizontal direction to simultaneously selectively engage the first and second pawls with the respective first and second plurality of rack teeth; and a spring acting against the catch for biasing the first and second pawls into engagement with the first and second plurality of rack teeth;

whereby the backrest is retained from falling downwardly from a desired vertical position by the engagement of the first and second pawls with the first and second plurality of rack teeth.

9. The adjustment mechanism of claim 8 wherein the catch is adapted to be slidably mounted to the backrest.

10. The adjustment mechanism of claim 9 wherein the first and second plurality of rack teeth protrude toward the catch from the support member, and the first and second pawls protrude toward the support member from the catch such that said first and second plurality of rack teeth and first and second pawls lie in the same plane when the first and second pawls are in the engaged and disengaged positions.

11. The adjustment mechanism of claim 8 wherein the catch is slidably mounted within a channel formed in the backrest.

12. The adjustment mechanism of claim 8 further comprising a rib extending outwardly from the backrest to act as a stop which contacts an upper edge of the support member when the backrest is lowered to a lowermost position.

13. The adjustment mechanism of claim 8 further comprising a hook extending outwardly from a top portion of the support member to act as a stop which contacts an upper edge of the channel member when the backrest is raised to an uppermost position.

14. The adjustment mechanism of claim 8 further comprising a lever in operable engagement with the catch, said catch having an angled end portion in slidable engagement with a complementary angled end portion of the lever such that movement of the lever creates a camming action which moves the catch in said linear, horizontal, lateral direction.

15. The adjustment mechanism of claim 14 wherein the lever has a lower vertical portion which is slidably mounted to the backrest, whereby vertical actuation of the lever is translated into horizontal actuation of the catch.

16. The adjustment mechanism of claim 8 wherein the first pawl comprises a first plurality of vertically aligned catch teeth which mate with selected ones of said first plurality of rack teeth, and the second pawl comprises a second plurality of vertically aligned catch teeth which mate with selected ones of said second plurality of rack teeth.

17. The adjustment mechanism of claim 8 wherein each of the first and second plurality of rack teeth is defined by a substantially horizontal upper edge and an upwardly inclined lower edge, and each of the first and second pawls is defined by an upwardly inclined upper edge and a substantially horizontal lower edge, whereby the backrest is moveable upwardly as the first and second pawls engage the first and second plurality of rack teeth in ratchet-like fashion.

18. An adjustment mechanism for releasably retaining a backrest in a plurality of selected positions relative to a seat, the adjustment mechanism comprising:

a channel member adapted to be rigidly secured to the backrest;

a support member slidably received by said channel member and adapted to be rigidly secured to the seat, said support member having a first plurality of vertically aligned rack teeth and a second plurality of vertically aligned rack teeth protruding therefrom toward the backrest in a generally lateral direction, said first and second plurality of rack teeth forming first and second arrays which are parallel and spaced apart from each other;

a catch slidably mounted to the backrest and constrained to movement in a linear, horizontal direction, said catch having a first plurality of vertically aligned catch teeth and a second plurality of vertically aligned catch teeth protruding therefrom toward the support member such that said first and second plurality of catch teeth lie in the same plane as the first and second plurality of rack teeth, said first plurality of catch teeth forming an array which, spaced apart from and parallel to an array formed by said second plurality of catch teeth, and said first and second plurality of catch teeth extending in the opposite direction as the first and second plurality of rack teeth, whereby movement of the catch in said linear, horizontal direction places the first and second plurality of catch teeth in simultaneous, selective engagement with the respective first and second plurality of rack teeth; and a spring acting against the catch for biasing the first and second plurality of catch teeth into engagement with the first and second plurality of rack teeth;

whereby the backrest is retained from falling downwardly from a desired vertical position by the engagement of the first and second pluralities of catch teeth with the first and second plurality of rack teeth.

19. The adjustment mechanism of claim 18 wherein the catch is slidably mounted within a channel formed in the backrest.

20. The adjustment mechanism of claim 18 further comprising a rib extending outwardly from the backrest to act as a stop which contacts an upper edge of the support member when the backrest is lowered to a lowermost position.

21. The adjustment mechanism of claim 18 further comprising a tab extending outwardly from a top portion of the support member to act as a stop which contacts an upper edge of the channel member when the backrest is raised to an uppermost position.

22. The adjustment mechanism of claim 18 further comprising a lever in operable engagement with the catch, said catch having an angled end portion in slidable engagement with a complementary angled end portion of the lever such that movement of the lever creates a camming action which moves the catch in said linear, horizontal, lateral direction.

23. The adjustment mechanism of claim 22 wherein the lever has a lower vertical portion which is slidably mounted to the backrest, whereby vertical actuation of the lever is translated into horizontal actuation of the catch.

24. The adjustment mechanism of claim 18 wherein each of the first and second plurality of rack teeth is defined by a substantially horizontal upper edge and an upwardly inclined lower edge, and each of the first and second pawls is defined by an upwardly inclined upper edge and a substantially horizontal lower edge, whereby the backrest is moveable upwardly as the first and second pawls engage the first and second plurality of rack teeth in ratchet-like fashion.

25. The apparatus of claim 18 wherein the adjustment mechanism comprises a plate mounted to a top portion of the support member, a tab extending rearwardly from a top edge portion of the plate and said plate having said first and second plurality of rack teeth extending therefrom for operable engagement with said first and second plurality of catch teeth.

* * * * *

UNITED STATES PATENT AND TRADEMARK OFFICE

CERTIFICATE OF CORRECTION

PATENT NO. : 5,586,809

DATED : December 24, 1996

INVENTOR(S) : John A. Szmadzinski

It is certified that error appears in the above-indentified patent and that said Letters Patent is hereby corrected as shown below:

In the Claims

In Claim 18, line 23, replace "which," with --which is--.

Signed and Sealed this

Fifteenth Day of September, 1998

*Attest:*

*Attesting Officer*

BRUCE LEHMAN

*Commissioner of Patents and Trademarks*